US008235511B2

(12) United States Patent
Koizumi

(10) Patent No.: US 8,235,511 B2
(45) Date of Patent: Aug. 7, 2012

(54) LIQUID EJECTING APPARATUS

(75) Inventor: Yoshihiro Koizumi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/175,535

(22) Filed: Jul. 1, 2011

(65) Prior Publication Data

US 2011/0261121 A1 Oct. 27, 2011

Related U.S. Application Data

(63) Continuation of application No. 12/568,868, filed on Sep. 29, 2009, now Pat. No. 7,997,699, which is a continuation of application No. 10/549,802, filed as application No. PCT/JP2004/003649 on Mar. 18, 2004, now Pat. No. 7,614,729.

(30) Foreign Application Priority Data

Mar. 18, 2003 (JP) ..... 2003-73600

(51) Int. Cl.
*B41J 2/175* (2006.01)

(52) U.S. Cl. ..... 347/85

(58) Field of Classification Search ..... 347/84–86, 347/94, 37

See application file for complete search history.

(56) References Cited

U.S. PATENT DOCUMENTS

| | | | | |
|---|---|---|---|---|
| 4,432,005 | A | 2/1984 | Duffield et al. | |
| 4,869,282 | A | 9/1989 | Sittler et al. | |
| 6,084,617 | A | 7/2000 | Balazer | |
| 6,213,600 | B1 | 4/2001 | Kobayashi et al. | |
| 6,536,885 | B2 | 3/2003 | Kuribayashi et al. | |
| 6,991,325 | B2 | 1/2006 | Oda et al. | |
| 7,090,341 | B1 | 8/2006 | Miyazawa | |
| 7,614,729 | B2 | 11/2009 | Koizumi | |
| 7,997,699 | B2 * | 8/2011 | Koizumi | 347/85 |
| 2001/0040610 | A1 | 11/2001 | Kurata et al. | |
| 2002/0140789 | A1 | 10/2002 | Tajima et al. | |

FOREIGN PATENT DOCUMENTS

| | | |
|---|---|---|
| EP | 1 231 062 A2 | 8/2002 |
| JP | 4-26730 U | 3/1992 |

(Continued)

OTHER PUBLICATIONS

European Search Report dated Jul. 21, 2010.

*Primary Examiner* — Geoffrey Mruk
(74) *Attorney, Agent, or Firm* — Sughrue Mion, PLLC

(57) ABSTRACT

The present invention is a liquid ejecting apparatus including: a carriage that reciprocates in a main scanning direction; a liquid ejecting head mounted on the carriage, having a plurality of head-liquid-supplying ports and a plurality of nozzles; and a sub-tank member mounted on the carriage, having a plurality of liquid-storing-room openings that are respectively communicated with the plurality of head-liquid-supplying ports of the liquid ejecting head. The sub-tank member is formed as a single integral member. Each of the plurality of liquid-storing-room openings is closed by an elastic partition having a predetermined area in order to form a liquid storing room. The plurality of liquid-storing-room openings are respectively communicated with a plurality of liquid-communication ways provided in the sub-tank member. The plurality of liquid-communication ways are respectively communicated with a plurality of sub-tank-liquid-supplying ports provided at an outside of the sub-tank member.

3 Claims, 12 Drawing Sheets

FOREIGN PATENT DOCUMENTS

| | | | |
|---|---|---|---|
| JP | 2001-63170 | A | 3/2001 |
| JP | 2001-232808 | A | 8/2001 |
| JP | 2002-127411 | A | 5/2002 |
| JP | 2002-200773 | A | 7/2002 |
| JP | 2002-211003 | A | 7/2002 |
| JP | 2002-273898 | A | 9/2002 |
| JP | 2003-34040 | A | 2/2003 |
| WO | 00/03877 | A1 | 1/2000 |

* cited by examiner

LIQUID EJECTING APPARATUS

CROSS-REFERENCE TO RELATED APPLICATION

This is a continuation of application Ser. No. 12/568,868 filed Sep. 29, 2009, which issued as U.S. Pat. No. 7,997,699, and which is a continuation of application Ser. No. 10/549,802 filed Sep. 19, 2005, which issued as U.S. Pat. No. 7,614,729, and which is a National Stage Application filed under §371 of PCT Application No. PCT/JP2004/003649 filed Mar. 18, 2004, and claims priority under 35 USC 119 from Japanese Patent Application No. 2003-73600. The entire disclosures of the prior applications are incorporated by reference herein.

FIELD OF THE INVENTION

This invention relates to a liquid ejecting apparatus comprising a carriage on which a liquid ejecting head and a sub tank is mounted, wherein a liquid is supplied from a liquid supplying source arranged on a side of a main unit to a liquid storing room of the sub tank through a liquid supplying way, the liquid is stored in the liquid storing room, and the liquid stored in the liquid storing room is supplied to the liquid ejecting head.

BACKGROUND OF THE INVENTION

Various types of liquid ejecting apparatuses for ejecting liquid from a nozzle are known. A typical one is an ink-jetting recording apparatus.

As shown in JP Laid-Open Publication No. 2001-232808 and JP Laid-Open Publication No. 2002-211003, an ink-jetting printer that is a typical example of ink-jetting recording apparatus ejects an ink drop toward a recording medium such as a recording paper, in order to record an image or characters.

For a printer coping with a large recording paper such as an "A0" size and/or for a printer coping with a large number of printing operations for a commercial use or the like, it is necessary to contain a large amount of ink, because a consumption amount of ink is large. In addition, in a printer capable of printing with many color inks, it is necessary to contain the respective color inks. Thus, an ink supplying source that can contain a large amount of ink, such as an ink tank or an ink cartridge, is arranged at a main unit of the printer. The ink is supplied from the ink supplying source to a recording head through an ink supplying tube.

In the above construction, in order to stabilize supply of the ink to the recording head, the sub tank is mounted on a carriage. Conventionally, each sub tank is mounted for each kind of ink. The ink supplied from the ink supplying source through the ink supplying tube is temporarily stored in an ink storing room of the sub tank, and then is supplied to the recording head. Preferably, a part of the ink storing room is formed by an elastic partition. In the case, the elastic partition can absorb pressure fluctuation of the ink caused by a main scanning operation of the carriage, so that the supply of the ink to the recording head is stabilized.

Herein, it is preferable that components of the ink-jetting recording apparatus are made as small as possible in order to positively advance conpactification of the apparatus and reduction of cost. If independent sub tanks are mounted on the carriage for the respective kinds of ink, the number of kinds of components and the number of the components are large depending on the number of the kinds of ink, which is disadvantageous for the reduction of cost. In addition, the number of assembling steps is also large. Furthermore, if each ink supplying tube is connected to each sub tank, the total ink supplying tubes takes a large space, and connecting operations thereof are much troublesome.

SUMMARY OF THE INVENTION

This invention is developed by focusing the aforementioned problems in order to resolve them effectively. The object of this invention is to provide a liquid ejecting apparatus wherein construction of a sub tank is much simplified and wherein absorbing function of pressure fluctuation in the sub tank is much improved.

This invention is a liquid ejecting apparatus comprising: a carriage that reciprocates in a main scanning direction; a liquid ejecting head mounted on the carriage, having a plurality of head-liquid-supplying ports and a plurality of nozzles; and a sub-tank member mounted on the carriage, having a plurality of liquid-storing-room openings that are respectively communicated with the plurality of head-liquid-supplying ports of the liquid ejecting head; wherein the sub-tank member is formed as a single integral member; each of the plurality of liquid-storing-room openings is closed by an elastic partition having a predetermined area in order to form a liquid storing room; the plurality of liquid-storing-room openings are respectively communicated with a plurality of liquid-communication ways provided in the sub-tank member; and the plurality of liquid-communication ways are respectively communicated with a plurality of sub-tank-liquid-supplying ports provided at an outside of the sub-tank member.

According to the invention, since the plurality of liquid storing rooms are formed in the single sub tank member, it is not necessary to form the plurality of liquid storing rooms as separate components, which is effective in simplifying construction.

For example, the plurality of liquid-storing-room openings have bottoms. In the case, it is preferable that all the plurality of liquid-storing-room openings are provided on one side of the sub-tank member. In addition, it is preferable that opening surfaces of the plurality of liquid-storing-room openings are located in a common flat plane.

In such a case, all the plurality of liquid-storing-room openings may be closed by a common elastic partition. In the case, arrangement of the elastic partition is completed by one step, so that simplification of manufacturing steps is promoted.

A part of each of the plurality of liquid-communication ways may be formed by a liquid-communication-way opening formed in the sub-tank member and an elastic partition closing the liquid-communication-way opening.

In the case, for example, the plurality of liquid-communication-way openings may be formed in parallel grooves. In the case, it is easy to form the plurality of liquid-communication-way openings.

In addition, it is preferable that all the plurality of liquid-storing-room openings and all the plurality of liquid-communication-way openings are closed by a common elastic partition. In the case, forming of the plurality of liquid storing rooms and forming of the plurality of liquid communication ways are completed by one arranging step of the elastic partition, so that simplification of manufacturing steps is promoted.

Alternatively, all the plurality of liquid-storing-room openings may be closed by a common first elastic partition, and all the plurality of liquid-communication-way openings may be closed by a common second elastic partition.

The elastic partition may be adhesively jointed to the sub-tank member in order to form the liquid storing rooms and the liquid communication ways.

In addition, it is preferable that the plurality of sub-tank-liquid-supplying ports is gathered. In the case, a member such as a liquid supplying tube forming the liquid supplying way is connected to the sub-tank-liquid-supplying port gathered and arranged at one position, so that a space necessary for connecting them may be reduced as much as possible. Thus, the sub tank may be made much more compact compared with prior art wherein a liquid supplying tube is connected to each of the plurality of sub tanks that are arranged independently.

In addition, it is preferable that the elastic partition closing each of the plurality of liquid-storing-room openings is arranged in parallel with the main scanning direction. In the case, when the sub-tank member is moved forward and backward in the main scanning direction, an inertial force by an inertial mass of the liquid in the liquid storing room doesn't act on the elastic partition directly. That is, the elastic partition can maintain a function of absorbing pressure fluctuation of the liquid within a normal range by means of elastic characteristics thereof. In particular, when the moving direction is turned over at an end portion of a main scanning range, the sub tank is decelerated rapidly and the inertial force acts on it greatly. However, even in such a situation, the normal function of the elastic partition may be maintained. In addition, it is also advantageous in improving durability of the elastic partition itself.

In addition, it is preferable that the elastic partition closing each of the plurality of liquid-storing-room openings is arranged substantially horizontally. In the case, a depth of the liquid storing room in a perpendicular direction with respect to the elastic partition may be made smaller, so that dimensions of the sub tank in the perpendicular direction may be made as small as possible. Thus, an occupancy space required near the carriage may be reduced.

Alternatively, the plurality of liquid-storing-room openings is through openings. In the case, elastic partitions are arranged at two positions for one liquid storing room. Thus, effective areas of the elastic partitions may be made as large as possible, so that a volume of the liquid storing room may be made as small as possible. Thus, the sub tank may be made compact, which is effective in reducing required space and cost.

In the case, it is preferable that opening surfaces on one side of the plurality of liquid-storing-room openings are located in a common first flat plane, opening surfaces on the other side of the plurality of liquid-storing-room openings are located in a common second flat plane, and the first flat plane and the second flat plane are parallel with each other.

In such a case, opening surfaces on one side of the plurality of liquid-storing-room openings may be closed by a common first elastic partition, and opening surfaces on the other side of the plurality of liquid-storing-room openings may be closed by a common second elastic partition. In the case, arrangement of the elastic partitions is completed by one step for each side, so that simplification of manufacturing steps is promoted.

Alternatively, the invention is a liquid ejecting apparatus comprising: a carriage that reciprocates in a main scanning direction; a liquid ejecting head mounted on the carriage, having a plurality of head-liquid-supplying ports and a plurality of nozzles; and a sub-tank member mounted on the carriage, having a plurality of liquid-storing-room openings that are respectively communicated with the plurality of head-liquid-supplying ports of the liquid ejecting head; wherein each of the plurality of liquid-storing-room openings is closed by an elastic partition having a predetermined area in order to form a liquid storing room; the plurality of liquid-storing-room openings are respectively communicated with a plurality of liquid-communication ways provided in the sub-tank member; the plurality of liquid-communication ways are respectively communicated with a plurality of sub-tank-liquid-supplying ports provided at an outside of the sub-tank member; and the plurality of sub-tank-liquid-supplying ports are gathered.

According to the invention, a member such as a liquid supplying tube forming the liquid supplying way is connected to the sub-tank-liquid-supplying port gathered and arranged at one position, so that a space necessary for connecting them may be reduced as much as possible. Thus, the sub tank may be made much more compact compared with prior art wherein a liquid supplying tube is connected to each of the plurality of sub tanks that are arranged independently.

For example, the elastic partition is formed by a synthetic resin film. For example, the synthetic resin film is a polyphenylene-sulfide film or a polyimide film. These films have a sufficient chemical durability against the liquid and a compliance function suitable for the pressure fluctuation of the liquid.

In addition, at least one of the liquid storing rooms and the liquid communication ways may have a valve mechanism that is opened by a negative pressure caused by liquid reduction.

In addition, the invention is a sub-tank member comprising: a plurality of liquid-storing-room openings that are respectively communicated with a plurality of head-liquid-supplying ports of a liquid ejecting head; a plurality of liquid-communication ways that are respectively communicated with the plurality of liquid-storing-room openings; and a plurality of sub-tank-liquid-supplying ports that are respectively communicated with the plurality of liquid-communication ways; wherein each of the plurality of liquid-storing-room openings is closed by an elastic partition having a predetermined area in order to form a liquid storing room; the sub-tank member is mounted on a carriage that reciprocates in a main scanning direction; and the sub-tank member is formed as a single integral member.

Alternatively, the invention is a sub-tank member comprising: a plurality of liquid-storing-room openings that are respectively communicated with a plurality of head-liquid-supplying ports of a liquid ejecting head; a plurality of liquid-communication ways that are respectively communicated with the plurality of liquid-storing-room openings; and a plurality of sub-tank-liquid-supplying ports that are respectively communicated with the plurality of liquid-communication ways; wherein each of the plurality of liquid-storing-room openings is closed by an elastic partition having a predetermined area in order to form a liquid storing room; the sub-tank member is mounted on a carriage that reciprocates in a main scanning direction; and the plurality of sub-tank-liquid-supplying ports are gathered.

BRIEF DESCRIPTION OF THE DRAWINGS

FIG. 10 is sectional views of an ink communication way and an ink storing room wherein a self-sealing valve mechanism is provided, in which FIG. 10(A) is a sectional view showing a valve-closed state and FIG. 10(B) is a sectional view showing a valve-opened state;

BEST MODE FOR CARRYING OUT THE INVENTION

Hereinafter, embodiments of the invention will be described with reference to drawings.

Figure 1:
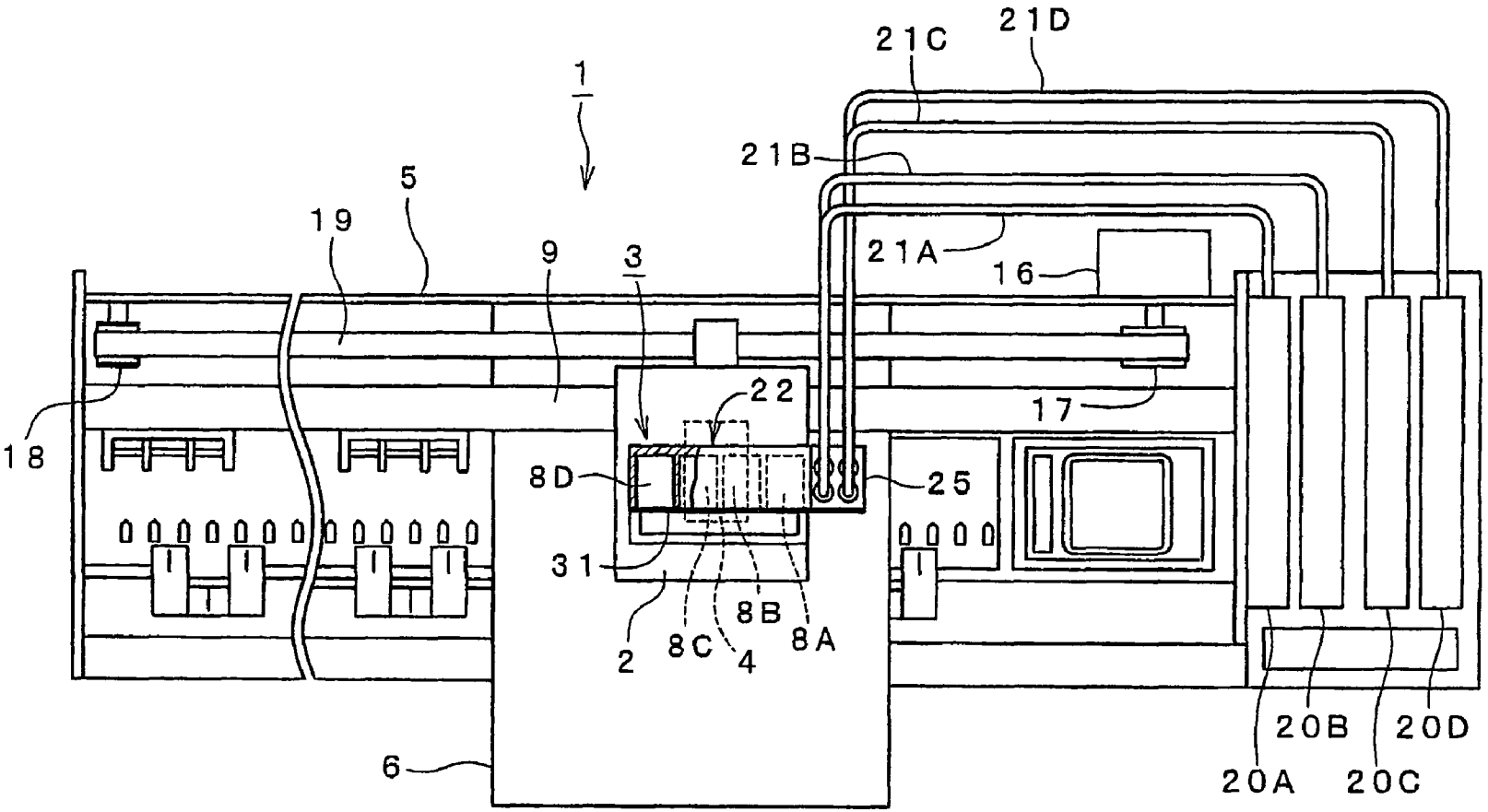
FIG. 1 is a schematic plan view of an ink-jetting printer of a first embodiment according to the invention.
Figure 2A:
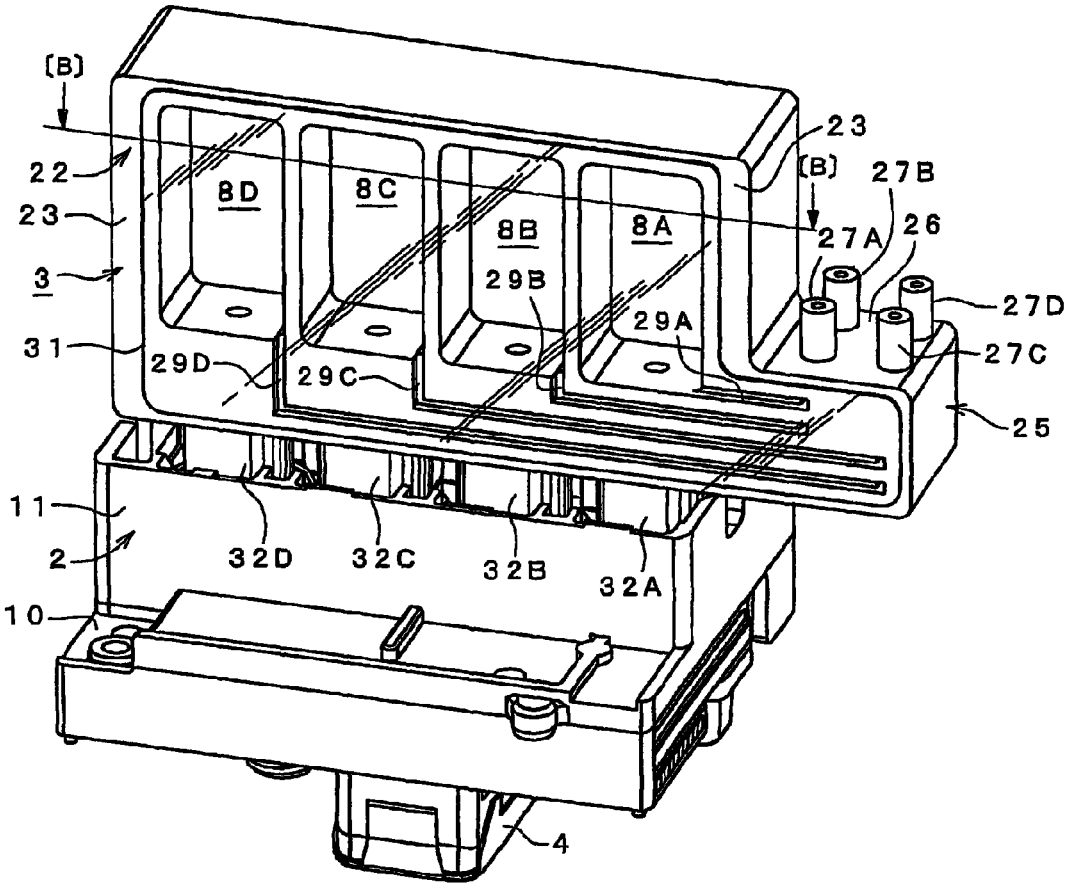
FIG. 2(A) is a perspective view of the carriage and the sub tank.
Figure 2B:
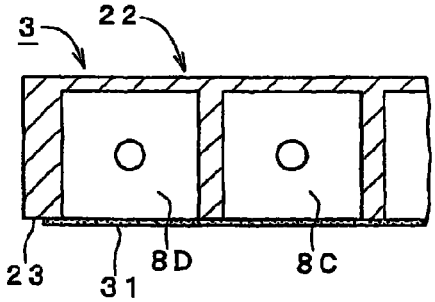
FIG. 2(B) is a sectional view taken along a line B-B of FIG. 2(A)
Figure 3A:
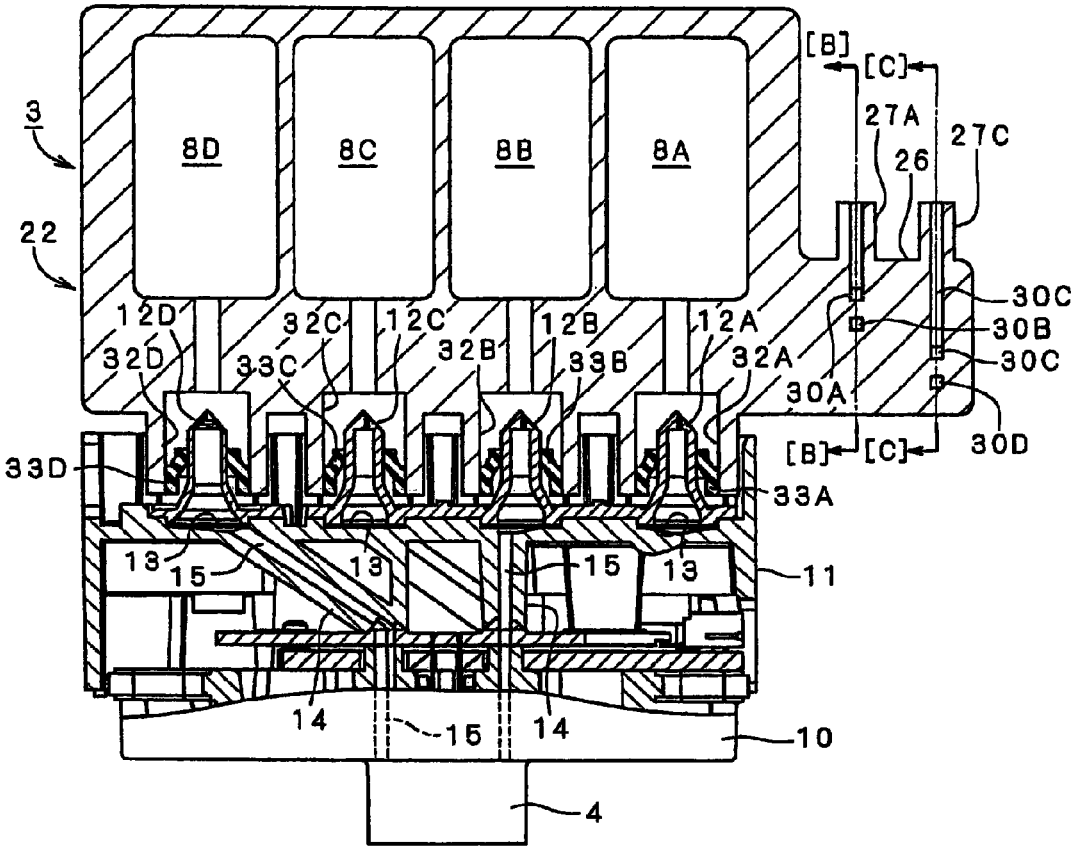
FIG. 3(A) is a longitudinal sectional view of the carriage and the sub tank.
Figure 3B:
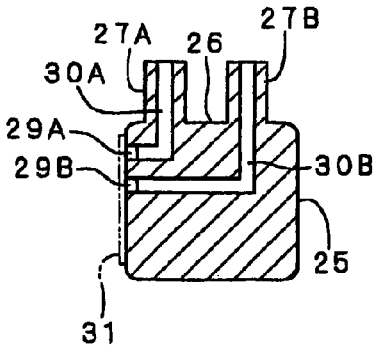
FIG. 3(B) is a sectional view taken along a line B-B of FIG. 3(A)
Figure 3C:
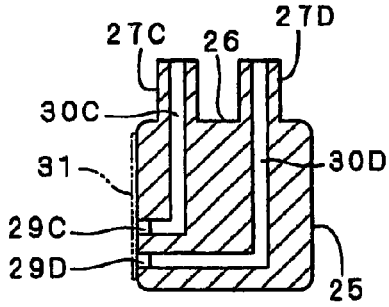
FIG. 3(C) is a sectional view taken along a line C-C of FIG. 3(A)

FIG. 1 is a schematic plan view of an ink-jetting printer 1 (hereinafter, referred to as printer 1) that is an ink-jetting recording apparatus as a first embodiment according to the invention. FIG. 2(A) is a perspective view of a carriage 2 seen from an obliquely upside thereof. FIG. 2(B) is a sectional view taken along a line B-B of FIG. 2(A). FIG. 3(A) is a longitudinal sectional view of the carriage 2 and a sub tank 3. FIG. 3(B) is a sectional view taken along a line B-B of FIG. 3(A). FIG. 3(C) is a sectional view taken along a line C-C of FIG. 3(A).

As shown in FIG. 1, the printer 1 is mainly formed by the carriage 2 and a printer main body 5, the sub tank 3 and a recording head 4 being mounted on the carriage 2. In the printer main body 5, provided are a head scanning mechanism that causes the carriage 2 to reciprocate in a main scanning direction, a paper feeding mechanism that feeds a recording paper 6 in a paper-feeding direction, a recovering mechanism that recovers a function of the recording head 4 that may be deteriorated by increase in viscosity of ink, and ink tanks 20A, 20B, 20C, 20D (a kind of ink supplying source) in which the ink to be supplied to the recording head 4 is stored.

As shown in FIG. 2(A), the carriage 2 has a mount base 10 formed in a substantially rectangular plate. The sub tank 3 is provided on a side of an upper surface of the mount base 10. The recording head 4 is provided on a side of a lower surface thereof. In more detail, a connecting frame 11 for connecting the sub tank 3 onto an upper surface of the mount base 10 is provided. Inside the connecting frame 11, ink supplying needles 12A, 12B, 12C, 12D and needle filters 13 are arranged (see FIG. 3). The ink supplying needles 12A, 12B, 12C, 12D and the needle filters 13 are provided correspondingly to a plurality of ink storing rooms 8A, 8B, 8C, 8D formed in the sub tank 3. In addition, as shown in FIG. 3, the recording head 4 is directly jointed to the lower surface of the mount base 10. Channel-forming parts 14 are formed at a lower portion of the connecting frame 11. Ink introducing ways 15 are formed in the channel-forming parts 14, and are communicated with ink introducing ways 15' provided in the mount base 10. Thus, ink introducing ways 15, 15' extend from the needle filters 13 to the recording head 4.

The head-scanning mechanism is formed by: a guide member 9 horizontally extending in a housing, a pulse motor 16 arranged at a side portion of the housing, a driving pulley 17 connected to a rotational shaft of the pulse motor 16, a free pulley 18 mounted at the other side portion of the housing, a timing belt 19 connected to the carriage 2 and going around the driving pulley 17 and the free pulley 18, and a controlling part (not shown) that controls rotation of the pulse motor 16. Thus, the carriage 2 i.e. the recording head 4 can reciprocate in the main scanning direction i.e. in a width direction of the recording paper 6, by driving the pulse motor 16.

In addition, in the present embodiment, four kinds of inks are used. Therefore, four ink storing rooms 8A, 8B, 8C, 8D are arranged alongside in the main scanning direction in the sub tank 3. The number of the ink storing rooms is not limited to four. If six color inks are used, six ink storing rooms may be arranged.

As shown in FIG. 1, the four ink tanks (or cartridges) 20A, 20B, 20C, 20D for four color inks are arranged at a side end portion of the printer main body 5. Ink supplying tubes 21A, 21B, 21C, 21D that extend from them are connected to a branch part of the sub tank 3 (described below). The sub tank 3 may be continuously used as it is even when the ink tanks are replaced.

The sub tank 3 is formed by a single sub-tank-forming member (sub-tank member) 22 and an elastic sheet 31 described below. For example, the sub-tank-forming member 22 may be formed by an injection molding from a synthetic resin material such as polyethylene or polypropylene.

The sub-tank-forming member 22 has a plate-like shape with a large thickness as a whole. Four concave bottom-having ink-storing-room openings (opening holes) are formed in the sub-tank-forming member 22 alongside in the main scanning direction. The ink-storing-room openings are sealed by the elastic sheet 31 in order to form the ink storing rooms 8A, 8B, 8C, 8D. Opening surfaces of the four ink-storing-room openings of the sub-tank-forming member 22 are located in a common flat place 23. In addition, in the sub-tank-forming member 22 of the present embodiment, four communication-way openings are formed, which are open at the edge surface 23. The four communication-way openings are formed in parallel grooves. Each of the communication-way openings is communicated with each of the ink-storing-room openings.

A part of the sub-tank-forming member 22 forms the branch part 25, which has a substantially rectangular parallelepiped shape. A connection-joint forming surface 26 is formed in the branch part 25. Pipe-shaped connection joints 27A, 27B, 27C, 27D are provided on the connection-joint forming surface 26 to protrude therefrom. Ink supplying tubes 21A, 21B, 21C, 21D are respectively connected to the pipe-shaped connection joints 27A, 27B, 27C, 27D. In the present embodiment, the communication-way openings extend to the branch part 25, and the edge surface 23 is different from the connection-joint forming surface 26.

The communication-way openings are sealed by the elastic sheet 31 so as to form communication ways 29A, 29B, 29C, 29D, which supply respective inks from the branch part 25 to the ink storing rooms 8A, 8B, 8C, 8D. The respective communication ways 29A, 29B, 29C, 29D are communicated with the respective connection joints 27A, 27B, 27C, 27D via inside communication ways 30A, 30B, 30C, 30D formed inside the branch part 25.

The elastic sheet 31 that is an elastic partition is adhesively jointed to the edge surface 23 by means of adhesive agent. Thus, the respective ink storing rooms 8A, 8B, 8C, 8D have a function of absorbing pressure fluctuation. The elastic sheet 31 is formed by a synthetic resin film such as a polyphenylene-sulfide film or a polyimide film.

In the present embodiment, the edge surface 23 is adjusted to be substantially parallel with the main scanning direction of the carriage 2. Thus, the elastic sheet 31 jointed to the edge surface 23 is also substantially parallel with the main scanning direction of the carriage 2.

As shown in FIGS. 2(A) and 3(A), on the side of the lower surface of the sub tank 3, cylindrical needle-connection parts 32A, 32B, 32C, 32D communicated with the respective ink storing rooms 8A, 8B, 8C, 8D are arranged just under the respective ink storing rooms 8A, 8B, 8C, 8D. When the sub tank 3 is mounted on the carriage 2, respective ink supplying needles 12A, 12B, 12C, 12D of the connection frame 11 relatively enter the insides of the respective needle-connection parts 32A, 32B, 32C, 32D. Thus, the ink storing rooms 8A, 8B, 8C, 8D are communicated with the nozzles of the recording head 4 via the respective ink supplying needles 12A, 12B, 12C, 12D, the ink introducing ways 15, 15', and the like. Herein, in FIG. 3, numeral signs 33A, 33B, 33C, 33D represent sealing members made of rubber.

As described above, the four needle-connection parts 32A, 32B, 32C, 32D are engaged with the ink supplying needles 12A, 12B, 12C, 12D via the sealing members 33A, 33B, 33C, 33D at the same time. Thus, joint rigidity of the sub tank 3 and the carriage 2 is high, that is, the sub tank 3 may be fixed stably.

As described above, the plurality of ink storing rooms 8A, 8B, 8C, 8D is formed by the single sub-tank forming member 22 and the elastic sheet 31. This is advantageous in simplifying structure, compared with a prior art wherein the plurality of ink storing rooms 8A, 8B, 8C, 8D is formed as separate components. In addition, the communication ways 29A, 29B, 29C, 29D, 30A, 30B, 30C, 30D are also formed in the single sub-tank forming member 22. This is suitable for smoothness of ink flows.

In addition, the plurality of ink-storing-room openings formed in the single sub-tank forming member 22 form the ink storing rooms 8A, 8B, 8C, 8D together with the elastic sheet 31 jointed to the edge surface 23. Thus, the structure of the ink storing rooms 8A, 8B, 8C, 8D is remarkably simplified. In addition, the plurality of ink storing rooms 8A, 8B, 8C, 8D can be formed by one jointing step of the one elastic sheet 31 to the edge surface 23. This can promote facilitation of manufacturing steps.

In addition, the communication-way openings are open at the single edge surface 23. Thus, the communication-way openings may be formed easily. Then, the communication ways 29A, 29B, 29C, 29D may be easily formed in grooves by the communication-way openings. In particular, since the edge surface 23 is covered by the one elastic sheet 31, forming of the communication ways 29A, 29B, 29C, 29D and forming of the respective ink storing rooms 8A, 8B, 8C, 8D may be completed at the same time, which may reduce the manufacturing steps. In particular, when the elastic sheet 31 consists of one film member, the jointing step of the elastic sheet 31 may be further simplified.

In addition, the branch part 25, which is a base point of the ink supply to the respective ink storing rooms 8A, 8B, 8C, 8D, is formed by a part of the sub-tank forming member 22. Thus, distribution of the plurality of kinds of inks into the respective ink storing rooms 8A, 8B, 8C, 8D may be achieved by the simplified structure. In addition, the branch part 25 can be made compact and can protrude from a main part of the sub tank 3. This is suitable to make the sub tank 3 compact.

In addition, the ink supplying tubes 21A, 21B, 21C, 21D are connected in a gathered manner to the connection joints 27A, 27B, 27C, 27D, which are arranged in a gathered manner at the connection-joint forming surface 26. Thus, a space necessary for connecting the ink supplying tubes 21A, 21B, 21C, 21D and the branch part 25 may be reduced as much as possible. That is, the sub tank 3 may be arranged more compactly compared with a prior art wherein each tube is connected to each of the plurality of sub tanks that are arranged independently.

Since the communication-way openings extend to the branch part 25 (except for the connection-joint forming surface 26), the communication ways 29A, 29B, 29C, 29D have a smooth flow-way structure from the branch part 25 to the ink storing rooms 8A, 8B, 8C, 8D. In addition, the structure of the communication ways 29A, 29B, 29C, 29D is simple.

In addition, mounting posture of the sub tank 3 is set in such a manner that the elastic sheet 31 is substantially parallel with the main scanning direction. Thus, when the sub tank 3 is moved forward and backward in the main scanning direction, an inertial force by an inertial mass of the ink in the ink storing rooms 8A, 8B, 8C, 8D doesn't act on the elastic sheet 31 directly. That is, the elastic sheet 31 can maintain a function of absorbing pressure fluctuation of the ink within a normal range by means of elastic characteristics thereof. In particular, when the moving direction is turned over at an end portion of a main scanning range, the sub tank 3 is decelerated rapidly and the above inertial force acts on it greatly. However, even in such a situation, the normal function of the elastic sheet 31 may be maintained. In addition, it is also advantageous in improving durability of the elastic sheet 31 itself.

Figure 4:
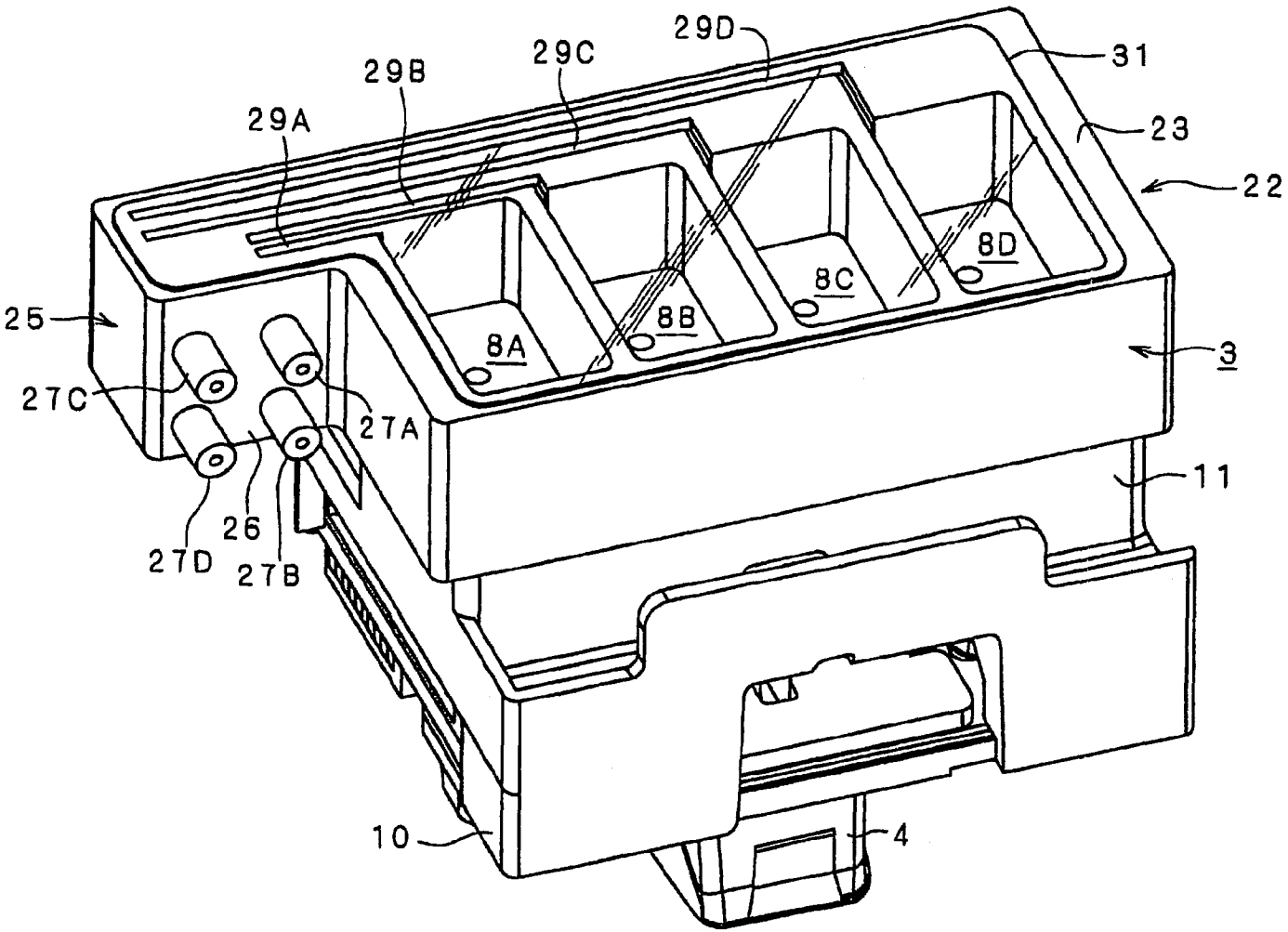
FIG. 4 is a perspective view of a carriage and a sub tank in an ink-jetting recording apparatus of a second embodiment according to the invention.

Next, FIG. 4 is a perspective view of a carriage in an ink-jetting recording apparatus of a second embodiment according to the invention.

In the second embodiment, mounting posture of the sub tank 3 is set in such a manner that the edge surface 23 is substantially horizontal. Then, the cylindrical needle-connection parts, not shown, are arranged on a side opposite to the elastic sheet 31. The other structures are substantially the same as the first embodiment. The same parts are represented by the same numeral signs, and explanation thereof is omitted.

When the above structure is adopted, a depth of the ink storing rooms 8A, 8B, 8C, 8D in a perpendicular direction with respect to the elastic sheet 31 may be made smaller, so that dimensions of the sub tank 3 in the perpendicular (vertical) direction may be made small. Thus, an occupancy space required near the carriage 2 may be reduced.

Figure 5A:
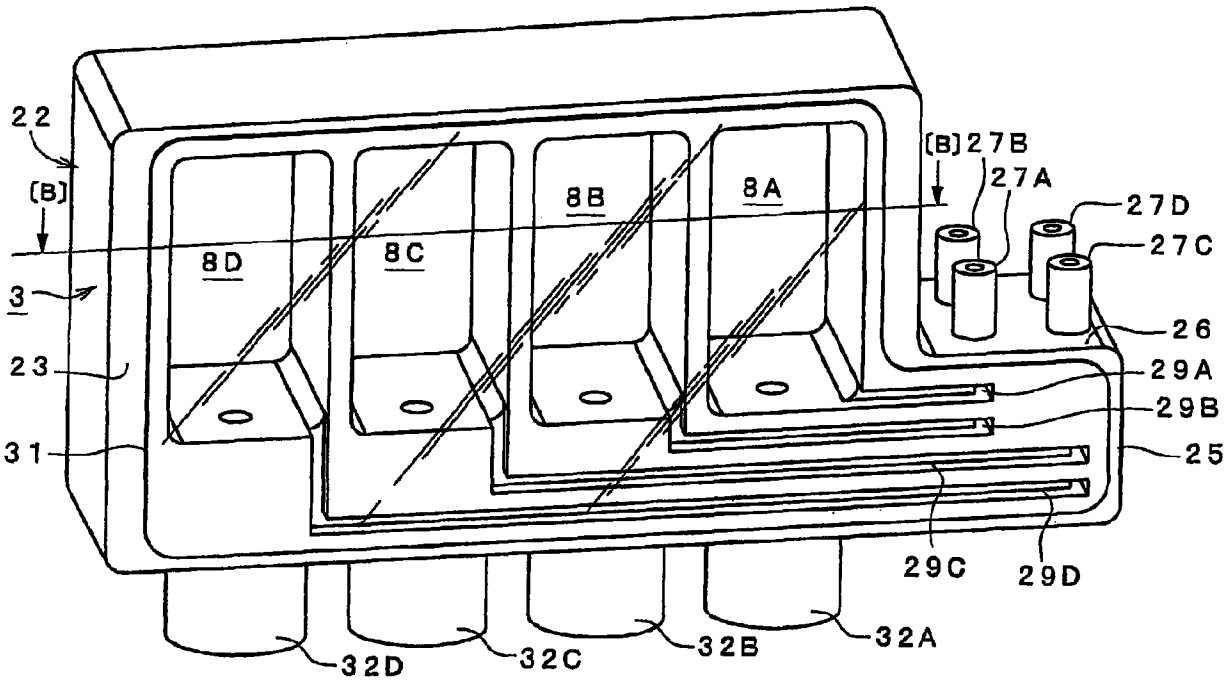
FIG. 5(A) is a perspective view of a sub tank in an ink-jetting recording apparatus of a third embodiment according to the invention.
Figure 5B:
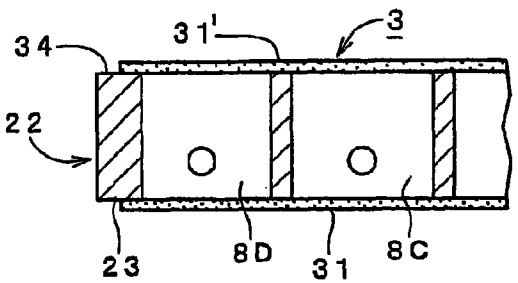
FIG. 5(B) is a sectional view taken along a line B-B of FIG. 5(A)
Figure 5C:
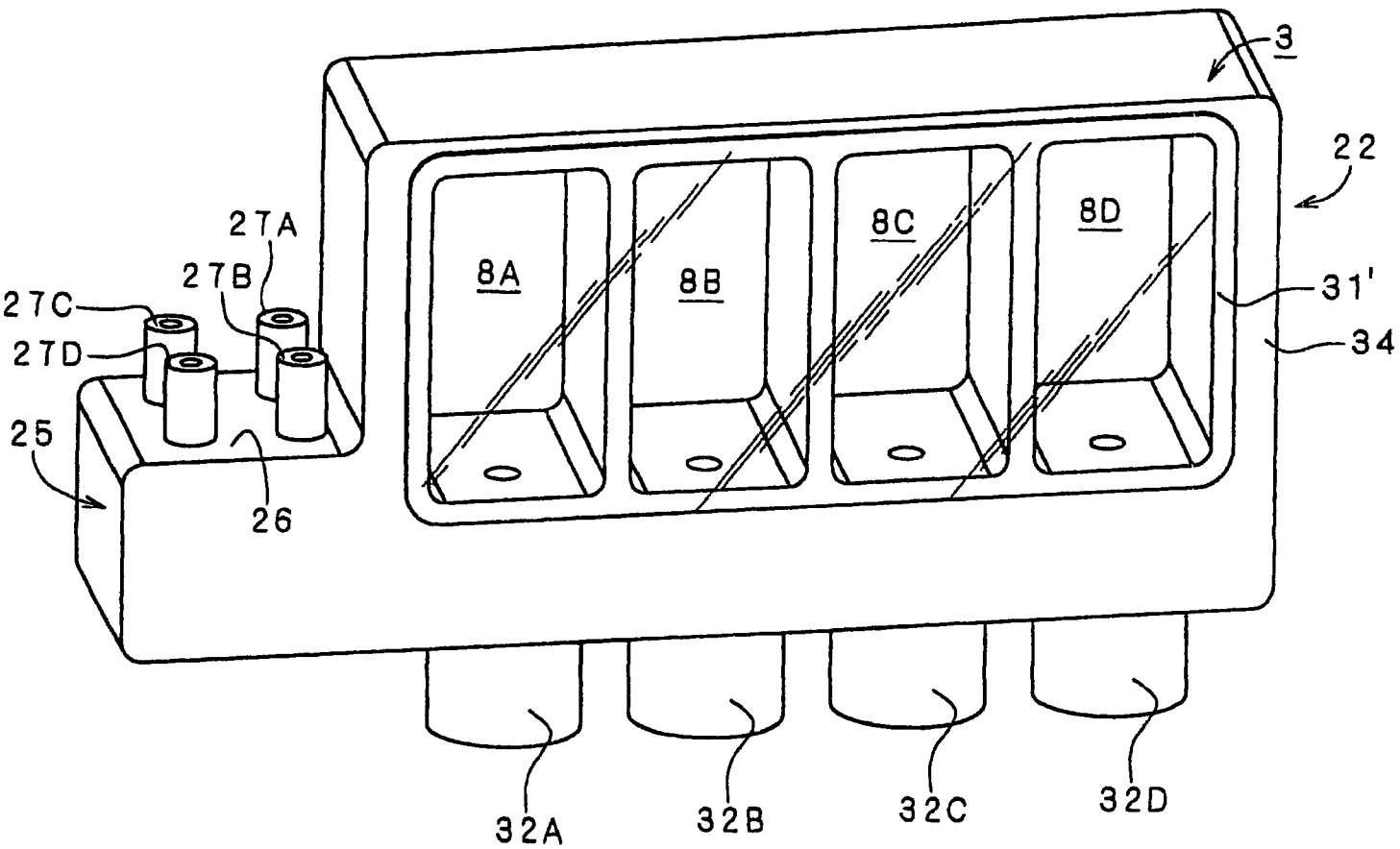
FIG. 5(C) is a perspective view of the sub tank of FIG. 5(A) seen from a backside thereof.

Next, FIGS. 5(A) to 5(C) are views showing a sub tank in a third embodiment according to the invention.

In the present embodiment, the ink-storing-room openings are also open at a flat reverse edge surface 34, oppositely to the edge surface 23. A second elastic sheet 31' is jointed to the reverse edge surface 34. The other structures are substantially the same as the first embodiment. The same parts are represented by the same numeral signs, and explanation thereof is omitted.

In the above structure, the respective ink storing rooms 8A, 8B, 8C, 8D can have the elastic sheets 31, 31' at the two surfaces. Thus, effective areas of the elastic sheets 31, 31' may be made as large as possible, so that a volume of each liquid storing room 8A, 8B, 8C, 8D may be made as small as possible. Thus, the sub tank 3 may be made more compact, which is effective in reducing required space and cost.

Figure 6A:
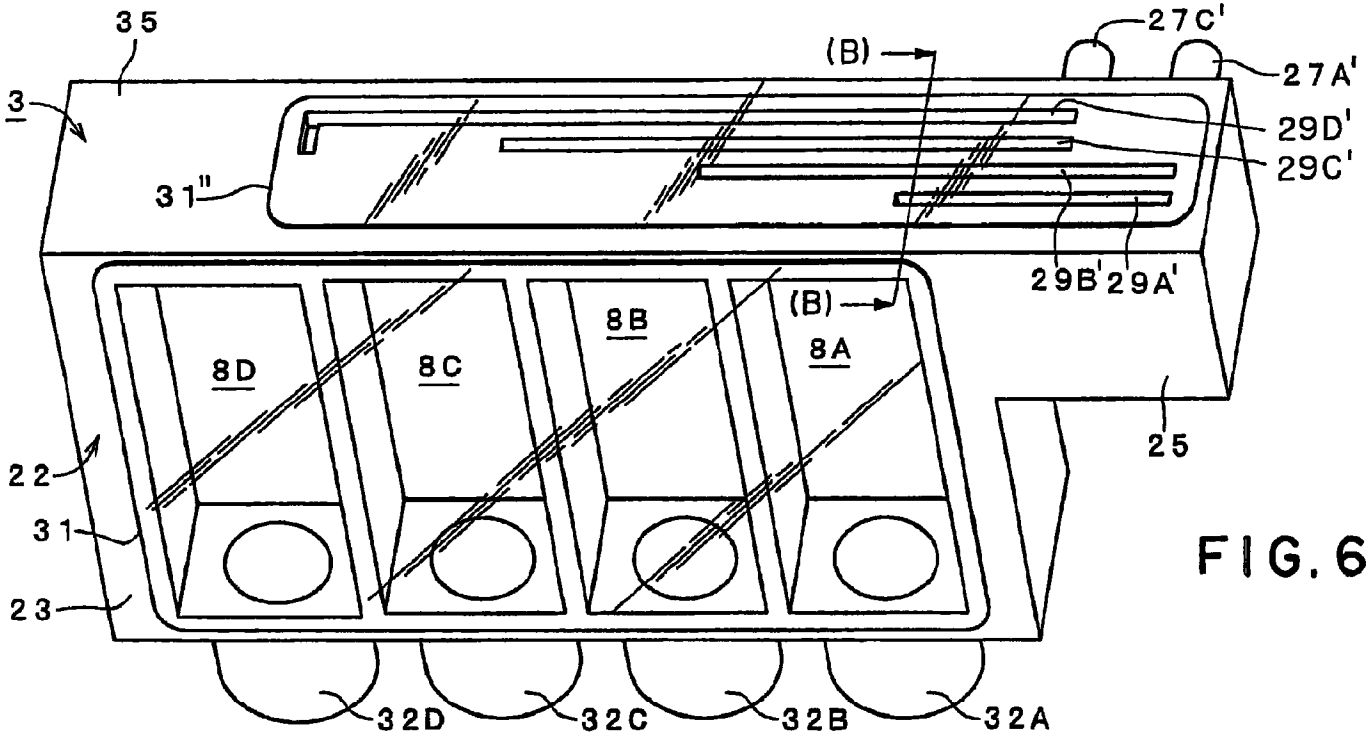
FIG. 6(A) is a perspective view of a sub tank in an ink-jetting recording apparatus of a fourth embodiment according to the invention.
Figure 6B:
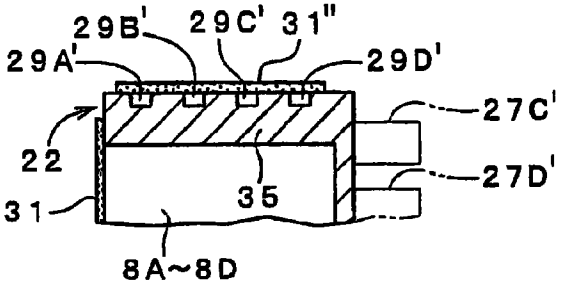
FIG. 6(B) is a sectional view taken along a line B-B of FIG. 6(A)

Next, FIGS. 6(A) and 6(B) are views showing a sub tank in a fourth embodiment according to the invention.

In the present embodiment, parallel groove-like communication-way openings are formed on an upper part 35 of the sub-tank forming member 22, instead of the edge surface 23. As shown in FIG. 6(B), a third elastic sheet 31" that is a sealing member is adhesively jointed to the groove-like communication-way openings, so that communication ways 29A', 29B', 29C', 29D' are formed. The other structures are substantially the same as the first embodiment. The same parts are represented by the same numeral signs, and explanation thereof is omitted.

In the above structure, it is unnecessary to provide the communication-way openings at the edge surface 23. Thus, the area of the edge surface 23 may be reduced. Thus, dimensions of the sub tank 3 in the longitudinal direction and in the transversal direction and the like may be shortened. Thus, the sub tank 3 may be made compact. In particular, if such dimension shortening is effectively used in a height direction of the apparatus main body, the height of the apparatus main body may be effectively shortened. Herein, it is preferable that the third elastic sheet 31" consists of the same material as the elastic sheet 31.

Figure 7:
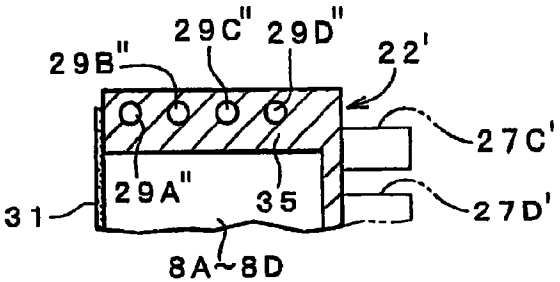
FIG. 7 is a sectional view of a variant of the sub tank in the ink-jetting recording apparatus of the fourth embodiment according to the invention.

In addition, as shown in FIG. 7 corresponding to FIG. 6(B), the thickness of the upper part 35 may be used so that communication ways 29A", 29B", 29C", 29D" having a circular section may be formed.

Figure 8:
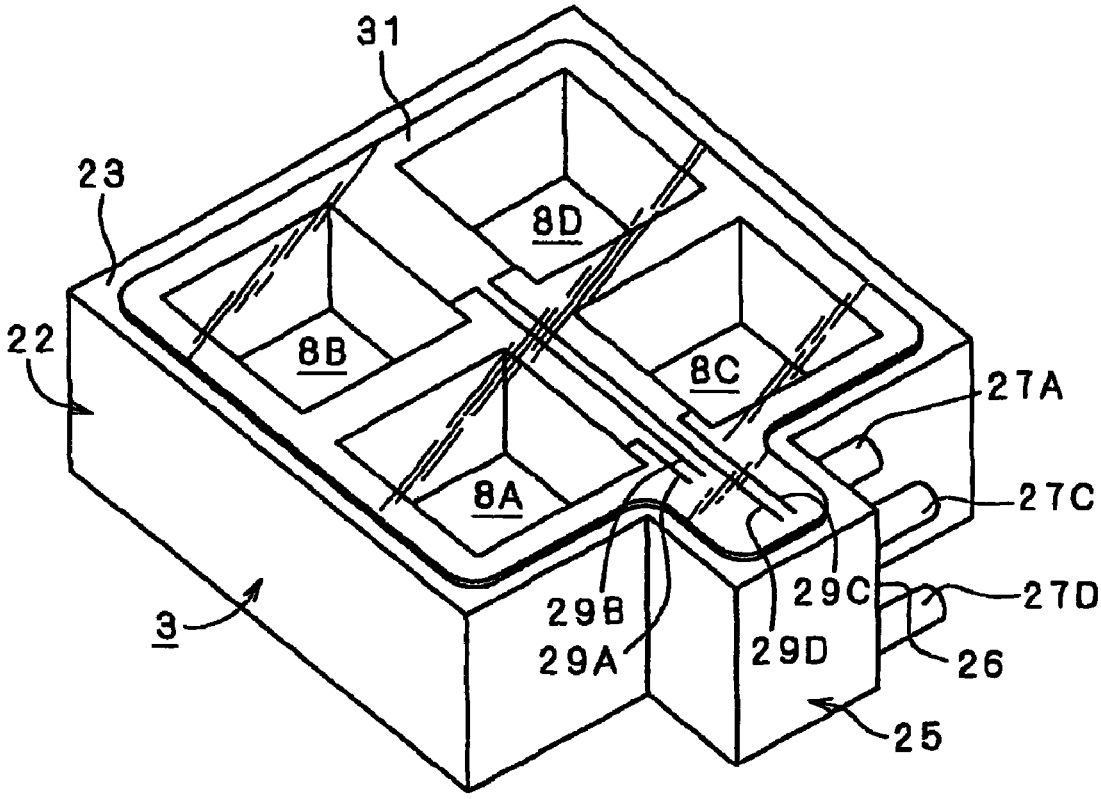
FIG. 8 is a perspective view of a sub tank in an ink-jetting recording apparatus of a fifth embodiment according to the invention.

Next, FIG. 8 is a perspective view showing a sub tank in a fifth embodiment according to the invention.

In the present embodiment, the four ink storing rooms 8A, 8B, 8C, 8D are arranged in a matrix of 2×2. The other structures are substantially the same as the first embodiment. The same parts are represented by the same numeral signs, and explanation thereof is omitted.

When the above structure is adopted, both longitudinal and transversal dimensions of the sub tank 3 can be within a size range of the carriage 2, so that the sub tank 3 and the carriage 2 can be united compactly.

In addition, the present invention has a feature that the single sub-tank forming member 22 is used. However, besides that feature, the present invention has another feature that the ink supplying ports (connection joints) of the sub tank are gathered.

Figure 9:
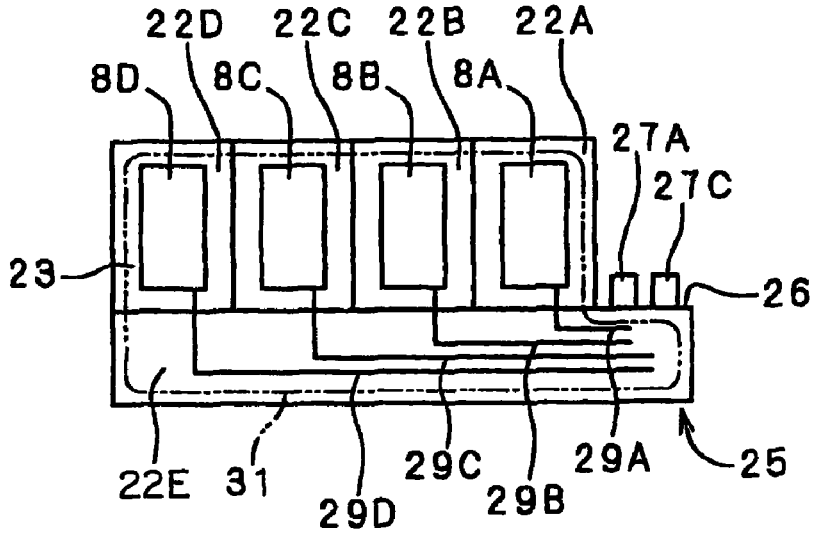
FIG. 9 is a perspective view of a sub tank in an ink-jetting recording apparatus of a sixth embodiment according to the invention.

Regarding the latter feature, FIG. 9 is a perspective view showing a carriage in a sixth embodiment according to the invention.

In the present embodiment, the sub-tank forming member 22 is formed by a plurality of components. That is, each sub-tank forming member 22A, 22B, 22C, 22D has an ink storing room 8A, 8B, 8C, 8D, and the sub-tank forming members 22A, 22B, 22C, 22D are united by an adhesive agent. In addition, a communication-way member 22E in which communication-way openings are formed is formed as a separate member, and a part of the communication-way member 22E forms the branch part 25. The communication-way member 22E and the sub-tank forming members 22A, 22B, 22C, 22D are united by an adhesive agent or the like.

According to the above structure as well, substantially the same effect as the first embodiment can be obtained. In addition, the ink storing rooms 8A, 8B, 8C, 8D can be freely combined, depending on the number of kinds of necessary inks. Thus, design of the sub tank 3 may be easily changed. In addition, the sub-tank forming members 22A, 22B, 22C, 22D and the communication-way member 22E may be manufactured in advance, and a variously specified sub tank 3 may be provided correspondingly to a request at each time. Thus, the number of kinds of molds may be reduced, so that cost reduction may be promoted.

Herein, it is of course that two ink storing rooms may be formed in one sub-tank forming member.

In the above respective embodiments, the elastic sheets 31, 31', 31" may consist of a synthetic resin film such as a polyphenylene-sulfide film or a polyimide film. These films have a sufficient chemical durability against the ink and a compliance function suitable for the pressure fluctuation of the ink. A thickness of the elastic sheet is not more than 10 μm, preferably not more than 5 μm, in order to suitably cope with the pressure fluctuation in the ink storing rooms 8A, 8B, 8C, 8D.

In addition, the elastic sheets 31, 31', 31" may consist of a synthetic resin film having a relatively small Young's modulus such as a polyethylene film. In the case, compared with the polyimide film or the like, the same effect may be obtained even if the thickness is doubled. In addition, the polyethylene film may be thermally jointed to a sub tank made of polyethylene, which may achieve simplification in manufacture.

In addition, the elastic sheets 31, 31', 31" may consist of a rubber member such as a butyl rubber, a silicon rubber, a fluorine rubber or an elastomer. A sufficient effect may be obtained by a thickness of about 0.4 mm. Such a rubber member has higher elastic operating characteristics as a pressure dumper than the sheet made of a synthetic resin film. That is, such a rubber member may achieve a superior dumping function.

In addition, in the above respective embodiments, in a center of each portion forming each ink storing room 8A, 8B, 8C, 8D of the elastic sheet 31, a pressure-receiving plate made of a hard material may be attached. The pressure-receiving plate has to be so light that it doesn't cause the elastic sheet 31 to move and doesn't give any change to the pressure in the ink storing room when the carriage 2 moves in a printing operation or the like. For example, it is preferable that the pressure-receiving plate is made of a plastic material such as polyethylene or polypropylene.

The pressure-receiving plate may be thermally attached (heat sealed) to the elastic sheet 31 in advance. Alternatively, it may be attached thereto by means of an adhesive agent or an adhesive double coated tape or the like. When the ink storing room is a very shallow cylindrical space as described below, it is preferable that the pressure-receiving plate has a circular shape and is arranged concentrically with the ink storing room.

Figure 10:
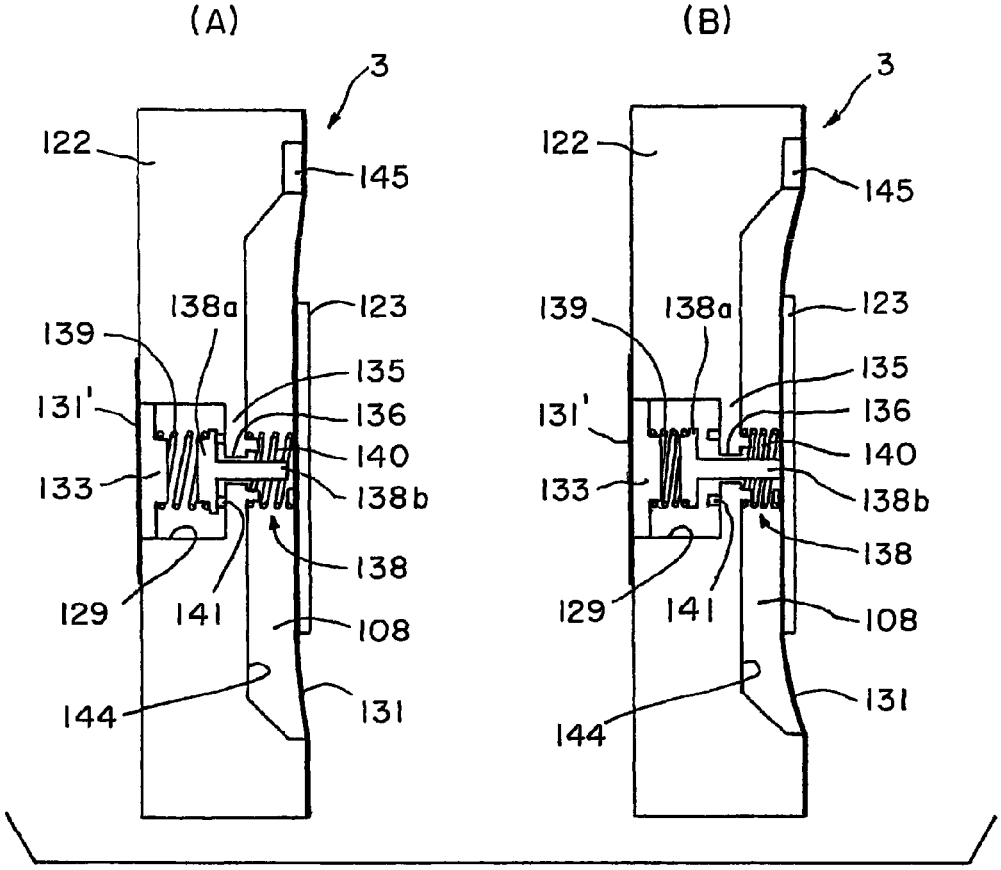

FIG. 10 is sectional views of an ink communication way and an ink storing room wherein a self-sealing valve mechanism is provided. In the case, as shown in FIG. 10, the ink communication way 129 has a cylindrical space of a small volume. A spring-receiving plate 133 is fitted at a side surface of a sub-tank forming member 122. The ink communication way 129 is sealed by the spring-receiving plate 133 and an elastic sheet 131'. The elastic sheet 131' is thermally jointed (heat sealed) to the sub-tank forming member 122.

In addition, the sub-tank forming member 122 has a partition 135 dividing the ink communication way 129 and the ink storing room 108. A supporting hole 136 is formed in the partition 135. The supporting hole 136 slidably supports a movable valve 138 described below. The movable valve 138 consists of a plate-like member 138*a*, and a rod member 138*b* integrally formed at a central portion of the plate-like member 138*a*. The rod member 138*b* can slidably move through the supporting hole 136.

In addition, a sealing coil spring 139 is arranged between the plate-like member 138*a* and the spring-receiving plate 133. Because of an action of the sealing spring 139, the plate-like member 138*a* is biased to the partition 135 by a small pressing force. On the other hand, a circular sealing member 141 made of rubber is attached to the partition 135 so as to surround the supporting hole 136. Thus, the plate-like member 138*a* of the movable valve 138 is adapted to come in contact with the sealing member 141 by means of the biasing force of the sealing spring 139. For example, the sealing member 141 is an O-ring or the like.

Figure 11:
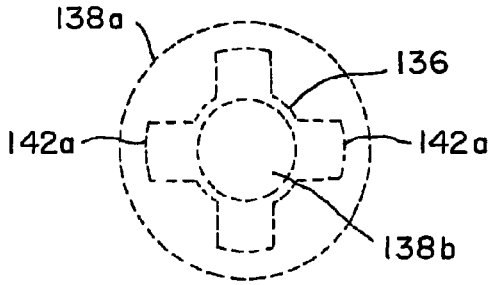
FIG. 11 is a schematic view showing a supporting hole and cut-off holes formed in the partition of the sub tank.

As enlarged and shown in FIG. 11, the supporting hole 136 formed in the partition 135 has intermittent cut-off holes 142*a*. Thus, an ink communication way extending from the ink communication way 129 to the ink storing room 108 is secured. Then, the sealing member 141 is provided on the partition 135 so as to surround the outside of the four cut-off holes 142*a*, although not shown in FIG. 11.

On the other hand, the ink storing room 108 is formed by a cylindrical concave portion (ink-storing-room opening) and the elastic sheet 131. The elastic sheet 131 is hermetically attached to the edge surface, in which the concave portion is formed, by mean of a heat sealing unit. Then, as described above, the circular pressure-receiving plate 123 is concentrically attached at the outside of the elastic sheet 131.

In addition, in the ink storing room 108, a negative-pressure-holding coil spring 140 is arranged around the rod member 138*b* of the movable valve 138. One end of the negative-pressure-holding spring 140 is held by a circular convex portion formed on the partition 135. The other end of the negative-pressure-holding spring 140 is fixed to the elastic sheet 131 to pull the same. Then, the negative-pressure-holding spring 140 biases the elastic sheet 131 in an expansion direction of the volume of the ink storing room 108, when the pressure-receiving plate 123 moves to compress the ink storing room 108.

In the embodiment shown in FIG. 10, a diameter of the negative-pressure-holding coil spring 140 is substantially the same as that of the sealing spring 139 and is relatively small. Preferably, the negative-pressure-holding spring 140 is adapted to come in contact with a substantially central portion of the pressure-receiving plate 123 via the elastic sheet 131.

On the other hand, an ink outlet port 145 is formed at an uppermost part of the ink storing room 108. Then, an ink outputting groove communicated with the ink outlet port 145 of the ink storing room 108 is formed in a circular arc shape along the concave portion forming the ink storing room 108. Herein, the ink outlet port 145 of the ink storing room 108 and the ink outputting groove communicated therewith are formed in the sub-tank forming member 122 and sealed by the elastic sheet 131.

Then, an ink communication way formed by the ink outputting groove is communicated with nozzles of the recording head 4 via an inside ink communication way of the sub-tank forming member 122. In the present embodiment, the ink outlet port 145 of the ink storing room 108 is formed at the uppermost part in a gravity direction. Thus, the ink storing room 108 can be filled with the ink without leaving air (air bubbles), for example when the ink is introduced into the recording apparatus for the first time.

Herein, in a non-printing state, that is, in a state wherein the ink is not consumed, a spring load W1 of the sealing spring 139 is applied to the plate-like member 138*a*, and a pressing force P1 of the ink supplied to the ink communication way 129 is also applied to the plate-like member 138*a*. Thus, as shown in FIG. 10(A), the plate-like member 138*a* comes in contact with the sealing member 141 to form a valve-closed state (self-sealing state).

On the other hand, in a printing state, that is, in a state wherein the ink is consumed, as the ink in the ink storing room 108 is reduced, the elastic sheet 131 moves toward the sub-tank forming member 122. At that time, the pressure-receiving plate 123 attached to the elastic sheet 131 moves in a contracting direction of the volume of the ink storing room 108 so as to compress the negative-pressure-holding coil spring 140. In addition, a central portion of the pressure-receiving plate 123 comes in contact with an end of the rod member 138*b* via the elastic sheet 131.

Herein, a spring load of the negative-pressure-holding spring 140 is represented by W2, a displacement-counter-force of the elastic sheet 131 itself is represented by Wd, and a negative pressure in the ink storing room 108 caused by consumption of the ink is represented by P2. At that time, if P2>W1+P1+Wd+W2, the elastic sheet 131 pushes the rod member 138*b*, so that the contact between the plate-like member 138*a* and the sealing member 141 is released and a valve-opened state is formed as shown in FIG. 10(B).

Thus, the ink in the ink communication way 129 is supplied into the ink storing room 108 via the cut-off holes 142*a*. When the ink is introduced into the ink storing room 108, the negative pressure in the ink storing room 108 disappears. Then, the movable valve 138 moves in such a manner that the valve-closed state shown in FIG. 10(A) is formed again and that the ink supply from the ink communication way 129 to the ink storing room 108 is stopped.

Herein, FIG. 10(B) shows an extremely exaggerated state regarding an opening-closing operation of the movable valve 138. Actually, the elastic sheet 131 is substantially in contact with the end of the rod member 138*b* forming the movable valve 138 to keep the balanced state, so that the valve is opened only a little as the ink is consumed. That is, the ink is supplied into the ink storing room 108 little by little.

The pressure-receiving plate 123 can receive an effect of the displacement of the elastic sheet 131 by the whole area of the pressure-receiving plate 123. Thus, the effect of the displacement of the elastic sheet 131 may be surely transmitted to the movable valve 138. Then, reliability of the opening-closing operation by the movable valve 138 may be improved.

In addition, the negative-pressure-holding spring 140 comes in contact with the elastic sheet 131 and urges the pressure-receiving plate 123 in the expansion direction of the volume of the ink storing room 108. This prevents displacement of the pressure-receiving plate 123 when the carriage reciprocates, so that malfunction in the opening-closing operation by the movable valve 138 may be effectively reduced.

The negative-pressure-holding spring 140 also effectively inhibits an effect of the elastic sheet 131 to bulge out at a lower portion of the ink storing room 108 because of gravity to the ink. That is, the negative-pressure-holding spring 140 has a function to always maintain a little negative pressure in the ink storing room 108. Thus, the pressure-receiving plate 123 attached to the elastic sheet 131 is always maintained in a vertical posture, so that malfunction in the opening-closing operation by the movable valve 138 may be effectively reduced.

In addition, even when the ink is supplied into the ink storing room 108, the negative-pressure-holding spring 140 expands and functions to maintain the little negative pressure in the ink storing room 108. Thus, pressure fluctuation in the ink storing room 108 may be reduced. Then, normal ink-drop ejecting operations from the nozzles in the recording head 4 may be assured.

In addition, according to the present embodiment, the negative pressure in the ink storing room 108 is adapted to be assured by the sum of the spring load by the negative-pressure-holding spring 140 and the spring load of the sealing spring 139. In other words, the spring load can be divided into that of the negative-pressure-holding spring 140 and that of the sealing spring 139. Then, the spring load of the sealing spring 139 for bringing the movable valve 138 in contact with the sealing member 141 in the valve-closed state can be selected smaller.

Thus, the contact pressure to the sealing member 141 by the elastomer resin or the like may be reduced, so that abnormal deformation of the sealing member 141 may be prevented. In addition, it can be prevented that an excessive spring load is applied to the sealing member 141. Thus, a problem may be avoided that impurities such as fats and fatty oils contained in the elastomer resin forming the sealing member 141 are interfused into the ink.

Figure 12:
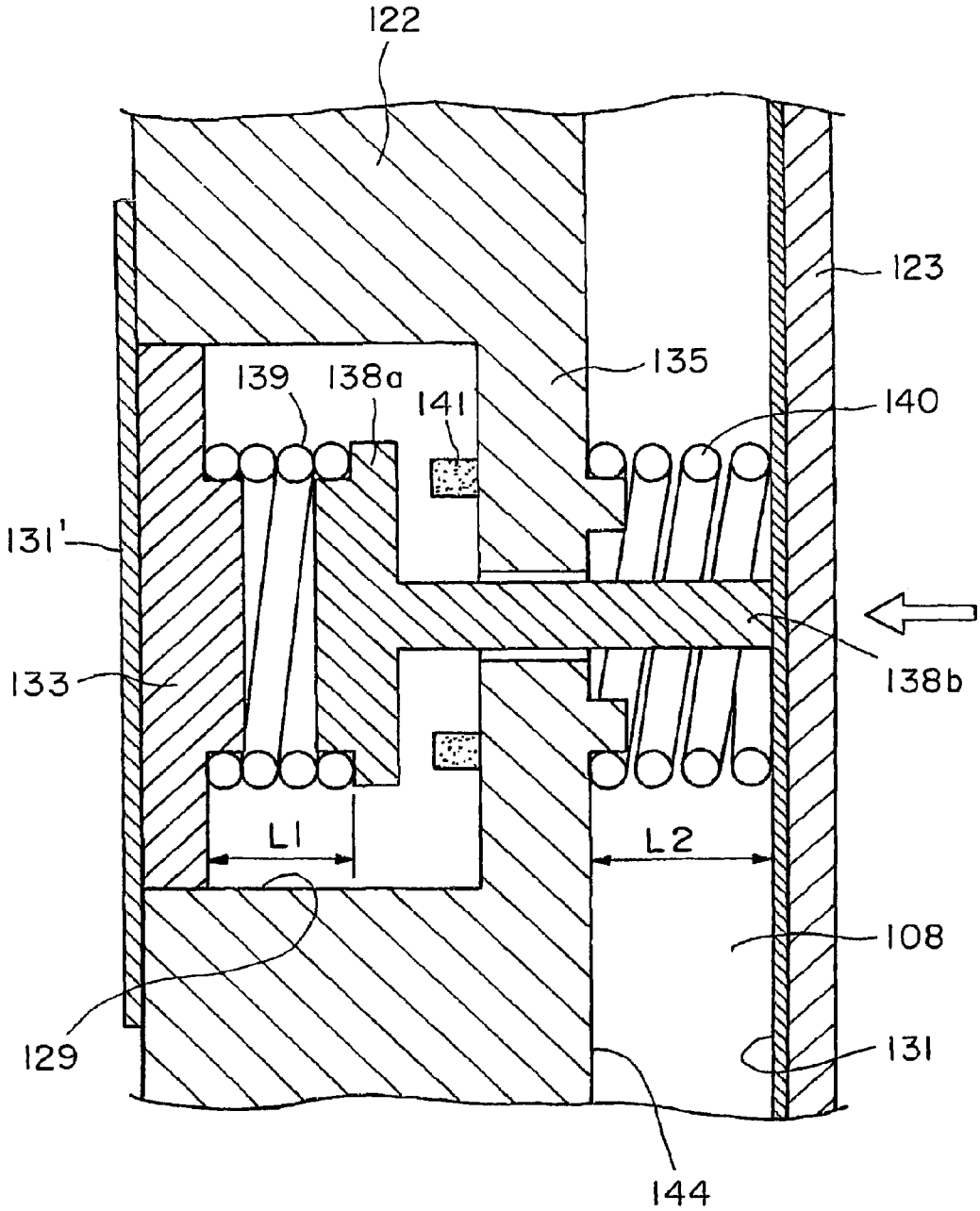
FIG. 12 is an enlarged sectional view for explaining a state wherein a movable valve has been moved at maximum.

On the other hand, in the above embodiment, when the movable valve 138 is moved maximally, it is preferable that a relationship of respective dimensions is determined in such a manner that there is left a further compressible stroke of the negative-pressure-holding spring 140. FIG. 12 is a view for explaining such a relationship of dimensions.

In FIG. 12, a compressed (cohesive, appressed) height of the sealing spring 139 under a state wherein the movable valve 138 has been moved maximally is represented by L1, and a compressed height of the negative-pressure-holding spring 140 under the state is represented by L2. That is, the relationship of dimensions is set in such a manner that the negative-pressure-holding spring 140 is not appressed even when the sealing spring 139 is compressed to a cohesive state. In other words, if a spring member of the same standard (dimensions) is used for the sealing spring 139 and the negative-pressure-holding spring 140, a relationship of L1<L2 is set. In the embodiment shown in FIG. 12, the ink flows into the ink storing room 108 through gaps of the negative-pressure-holding spring 140. Thus, if the negative-pressure-holding spring 140 is compressed cohesively (appressed), the ink flow way may be closed, that is, the ink supply may be stopped. Thus, it is preferable to avoid the problem by setting the above L1<L2 or the like.

Figure 13:
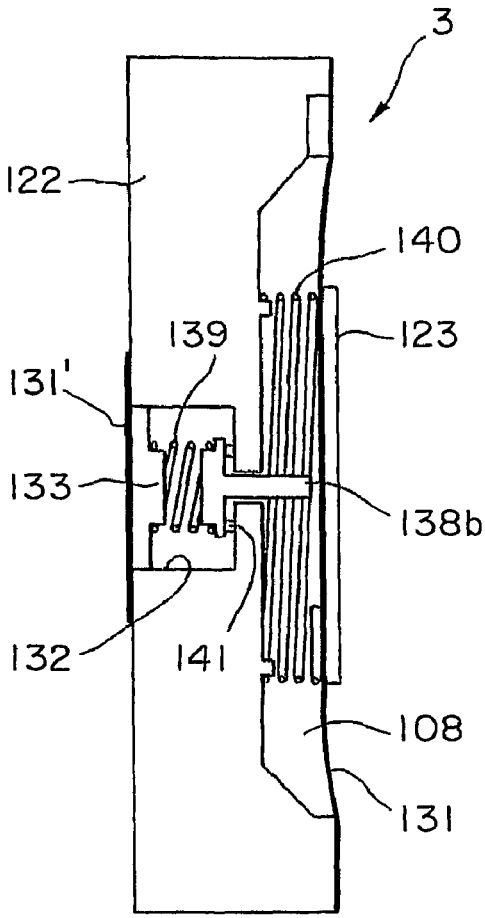
FIG. 13 is a sectional view of a sub tank wherein a variant of the self-sealing valve mechanism is provided.

In addition, as shown in FIG. 13, compared with the embodiment shown in FIG. 10, the diameter of the negative-pressure-holding coil spring 140 may be enlarged. In the case, the negative-pressure-holding spring 140 is adapted to come in contact with a peripheral part of the circle-shaped pressure-receiving plate 123 via the elastic sheet 131.

According to the above construction, the pressure-receiving plate 123 comes in contact with the negative-pressure-holding spring 140 in the vicinity of the periphery thereof. Thus, inhibited is the effect of the elastic sheet 131 to bulge out at a lower portion of the ink storing room 108 because of gravity to the ink. Thus, the pressure-receiving plate 123 is always maintained in a vertical posture, so that malfunction in the opening-closing operation by the movable valve 138 may be effectively reduced.

Figure 14:
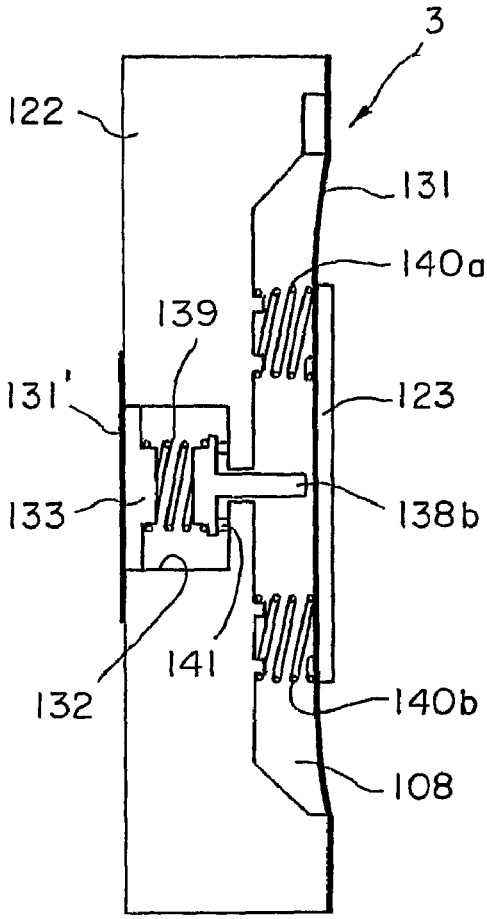
FIG. 14 is a sectional view of a sub tank wherein another variant of the self-sealing valve mechanism is provided.

Alternatively, as shown in FIG. 14, as a negative-pressure-holding spring, a plurality of coil springs 140*a*, 140*b* having small coil diameters may be used. According to this construction as well, inhibited is the effect of the elastic sheet 131 to bulge out at a lower portion of the ink storing room 108 because of gravity to the ink. Thus, the pressure-receiving plate 123 is always maintained in a vertical posture, so that malfunction in the opening-closing operation by the movable valve 138 may be effectively reduced.

In addition, in the embodiment shown in FIG. 14, the two coil springs 140*a*, 140*b* are used, but more coil springs may be used. When n coil springs are used, if a spring load of the negative-pressure-holding spring is represented by W2 as described above, a spring load of each coil spring has to be set to W2/n.

Figure 15A:
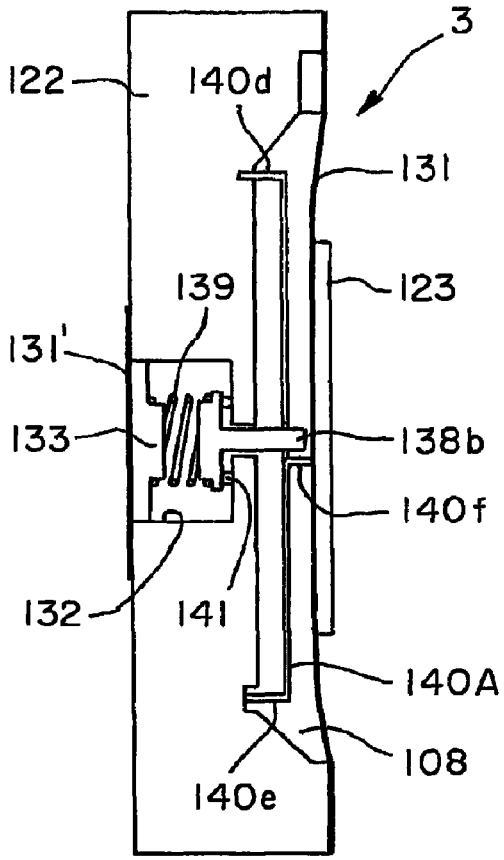
FIG. 15(A) is a sectional view of a sub tank wherein further another variant of the self-sealing valve mechanism is provided.
Figure 15B:
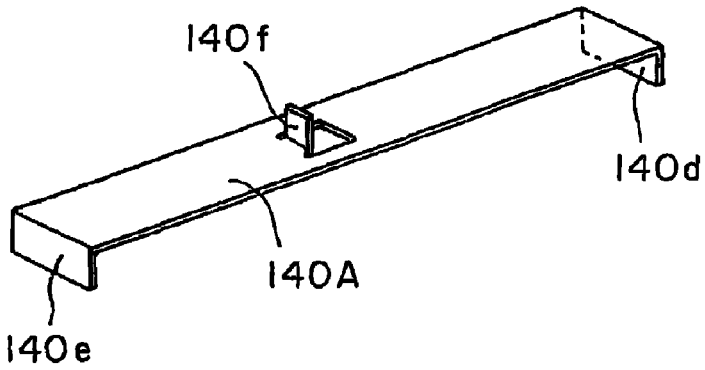
FIG. 15(B) is a perspective view of the flat spring in FIG. 15(A).

In addition, as shown in FIG. 15, as the negative-pressure-holding spring, a plate spring 140A may be adopted. As shown in FIG. 15(B), both end portions of the plate spring 140A are bent in the same direction to form a pair of leg portions 140*d*, 140*e*. In a central portion thereof, a standing cut portion 140*f* is formed in a reverse direction to the bent direction of the leg portions.

In the above plate spring 140A, as shown in FIG. 15(A), one leg portion 140*d* is fixed to the sub-tank forming member 122 in the ink storing room 108. In addition, the rod member 138*b* of the movable valve is inserted into an opening formed by forming the standing cut portion 140*f*, and a tip part of the standing cut portion 140*f* is adapted to come in contact with a substantially central portion of the pressure-receiving plate 124 via the elastic sheet 131.

According to the above construction as well, against the displacement of the pressure-receiving plate 123, the plate spring 140A can urge the elastic sheet 131 in the expansion direction of the volume of the ink storing room 108.

The above description is given for an ink-jetting recording apparatus. However, this invention is intended to apply to general liquid ejecting apparatuses widely. A liquid may be glue, nail polish, electrically conductive liquid (liquid metal) for forming an electric circuit, or the like. In addition, this invention can be also applied to an apparatus for manufacturing color filters of a display member such as a liquid crystal display, an apparatus for ejecting electrode material used in forming an electrode of an organic EL display, an FED (face emission display) or the like, an apparatus for ejecting organic liquid used in manufacturing biochips, or the like.

What is claimed is:

1. A liquid ejecting apparatus comprising:

a liquid ejecting head;

a carriage that moves with said liquid ejecting head in a main scanning direction;

a sub-tank-forming member formed with a groove and an opening which are sealed with a film to form a liquid passage and a liquid storing room; and a main tank coupled to the sub-tank-forming member by a tube, wherein the sub-tank-forming member is disposed above said carriage and said liquid ejecting head is disposed under said sub-tank-forming member.

2. The liquid ejecting apparatus according to claim 1, wherein said sub-tank-forming member is formed with a plurality of liquid storing rooms and said plurality of liquid storing rooms are arranged side by side in the main scanning direction.

3. The liquid ejecting apparatus according to claim 1, wherein said liquid storing room has a valve movable in accordance with a change in pressure in the liquid storing room.

* * * * *